US009218929B2

(12) United States Patent
Lehmann et al.

(10) Patent No.: US 9,218,929 B2
(45) Date of Patent: Dec. 22, 2015

(54) THERMOMAGNETIC TRIP FOR SMALL CURRENT RANGES

(71) Applicants: Stephan Lehmann, Hahnbach (DE); Michael Poles, Radevormwald (DE)

(72) Inventors: Stephan Lehmann, Hahnbach (DE); Michael Poles, Radevormwald (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 436 days.

(21) Appl. No.: 13/713,506

(22) Filed: Dec. 13, 2012

(65) Prior Publication Data

US 2013/0207768 A1 Aug. 15, 2013

(30) Foreign Application Priority Data

Feb. 14, 2012 (DE) ..... 10 2012 202 153

(51) Int. Cl.

| | |
|---|---|
| ***H01H 37/14*** | (2006.01) |
| ***H01H 37/32*** | (2006.01) |
| ***H01H 37/34*** | (2006.01) |
| ***H01H 37/52*** | (2006.01) |
| ***H01H 71/00*** | (2006.01) |
| ***H01H 71/16*** | (2006.01) |
| ***H01H 71/24*** | (2006.01) |
| ***H01H 71/40*** | (2006.01) |

(52) U.S. Cl.

CPC ..... *H01H 37/52* (2013.01); *H01H 71/00* (2013.01); *H01H 71/164* (2013.01); *H01H 71/2472* (2013.01); *H01H 71/402* (2013.01)

(58) Field of Classification Search

CPC ..... H01H 37/52; H01H 71/00; H01H 71/402; H01H 71/2472; H01H 71/164

USPC ..... 337/2, 3, 12, 13, 36, 54, 102

See application file for complete search history.

(56) References Cited

U.S. PATENT DOCUMENTS

| | | | | |
|---|---|---|---|---|
| 4,187,482 | A * | 2/1980 | Kosup | 335/12 |
| 5,237,297 | A * | 8/1993 | Ellington et al. | 335/35 |
| 5,381,120 | A * | 1/1995 | Arnold et al. | 335/35 |

(Continued)

FOREIGN PATENT DOCUMENTS

| | | | |
|---|---|---|---|
| CN | 2891264 | Y | 4/2007 |
| CN | 101685728 | A | 3/2010 |

(Continued)

OTHER PUBLICATIONS

Chinese Office Action dated Aug. 20, 2015 for corresponding CN Application No. 201310051169.5.

*Primary Examiner* — Anatoly Vortman

(74) *Attorney, Agent, or Firm* — Harness, Dickey & Pierce, P.L.C.

(57) ABSTRACT

A thermomagnetic trip is disclosed for an electrical switching device, especially a circuit breaker. In at least one embodiment it includes at least one first and one second terminal, a first heating element, a conductor able to be influenced by temperature, a yoke and a clapper armature. A current path is formed through at least the first terminal, the conductor, the first heating element and the second terminal. The current path is disposed at least in sections on and/or in the yoke such that a magnetic field acting on the clapper armature is induced in the yoke by the current flowing through the current path and wherein a second heating element is disposed in the current path especially between the first terminal and the conductor.

12 Claims, 3 Drawing Sheets

(56) References Cited

U.S. PATENT DOCUMENTS

| | | | | |
|---|---|---|---|---|
| 5,831,509 | A * | 11/1998 | Elms et al. | 337/333 |
| 5,844,466 | A * | 12/1998 | Fraisse | 337/379 |
| 5,872,495 | A | 2/1999 | Black et al. | |
| 6,326,869 | B1 * | 12/2001 | Felden et al. | 335/35 |
| 7,518,482 | B2 * | 4/2009 | Fleege | 337/59 |
| 7,800,478 | B2 * | 9/2010 | Puhalla et al. | 337/107 |
| 2004/0227602 | A1 * | 11/2004 | Ciarcia et al. | 335/172 |
| 2008/0094155 | A1 * | 4/2008 | Fleege | 335/6 |
| 2009/0223793 | A1 * | 9/2009 | Robbins et al. | 200/271 |
| 2010/0164658 | A1 * | 7/2010 | Woo | 335/21 |

FOREIGN PATENT DOCUMENTS

| | | | |
|---|---|---|---|
| CN | 201594512 | U | 9/2010 |
| DE | 102006005697 | A1 | 8/2007 |
| DE | 60036365 | T2 | 6/2008 |

* cited by examiner

THERMOMAGNETIC TRIP FOR SMALL CURRENT RANGES

PRIORITY STATEMENT

The present application hereby claims priority under 35 U.S.C. §119 to German patent application number DE 10 2012 202 153.1 filed Feb. 14, 2012, the entire contents of which are hereby incorporated herein by reference.

FIELD

At least one embodiment of the present invention generally relates to a thermomagnetic trip for an electrical switching device and/or to an electrical switching device with a thermomagnetic trip.

BACKGROUND

A thermomagnetic trip in an electrical switching device has the task of monitoring the current flowing through the switching device. If an overload is reached as a result of too great a current flowing through the device an opening of the contacts and thereby an interruption of the current flow is initiated by the thermal trip part of the thermomagnetic trip. The magnetic trip part of an electrical switching device is used for the detection of a short circuit. In the event of a short circuit an immediate tripping of the thermomagnetic trip is required, on the one hand to prevent danger to the downstream electrical devices or the users of these devices, on the other hand to protect the thermal trip part. The thermal trip part resides in such cases especially of a conductor through which current is flowing, able to be influenced by temperature, which has at least two terminals for connection to the circuit to be switched. The magnetic part of the trip mostly consists of a yoke in which a magnetic field is induced by the aforementioned current flow, and an armature able to be influenced by the current flow which, attracted by the large magnetic field induced during a short circuit, executes a movement in the direction of the yoke and causes the current to be interrupted itself or through downstream mechanisms.

A thermomagnetic trip of this type is known from DE 600 36 365 T2. An additional heating element, which is connected in series with the conductor able to be influenced by temperature, is provided in this thermomagnetic trip. It is located between the conductor able to be influenced by temperature and the terminal of the thermomagnetic trip able to be connected to a power lead. In this invention the additional heating element and the conductor able to be influenced by temperature are disposed within a yoke such that they have the same current flow direction. On the one hand this arrangement increases the temperature effect on the conductor able to be influenced by temperature and in addition the sensitivity of the magnetic trip is increased. However such an arrangement has been proved to have the disadvantage that, in order to achieve the same current direction in the additional heating element and the conductor able to be influenced by temperature, an increased space requirement in the transverse direction is needed to move the armature of the magnetic trip part. Furthermore in this thermomagnetic trip the conductor able to be influenced by temperature is connected via a wire directly to the customer terminal. Since the customer terminal has a significantly lower temperature than the conductor able to be influenced by temperature, heat is taken out of the conductor able to be influenced by temperature and thereby the response behavior of the conductor able to be influenced by temperature and thus of the thermal trip part is worsened.

SUMMARY

At least one embodiment of the present invention is directed to overcoming at least partly the disadvantages described above of known thermomagnetic trips. In particular, at least one embodiment of the present invention provides a thermomagnetic trip or an electrical switching device having a thermomagnetic trip in which the tripping behavior of the thermal trip part and/or the magnetic trip part is improved. In particular a thermomagnetic trip or an electrical switching device having a thermomagnetic trip which are also able to be used for small currents are to be produced.

Further features and details of the invention emerge from the description and the drawings. In such cases features and details which are described in conjunction with at least one emodiment of the inventive thermomagnetic trip naturally also apply in conjunction with at least one embodiment of the inventive electrical switching device and vice versa in each case, so that, in relation to the disclosure, the individual aspects of the invention always reference one another or can reference one another.

A thermomagnetic trip is disclosed in at least one embodiment for an electrical switching device, especially for a circuit breaker, and includes at least one first and one second terminal, a first heating element, a conductor able to be influenced by temperature, a yoke and a clapper armature, wherein a current path is formed through at least the first terminal, the conductor able to be influenced by temperature, the first heating element and the second terminal and whereby the current path is disposed at least in sections on and/or in the yoke such that a magnetic field acting on the clapper armature is initiated by a current flowing through the current path. In particular there is provision, in a thermomagnetic trip for an electrical switching device, for a second heating element to be disposed in the current path between the first terminal and the conductor able to be influenced by temperature. The resistance of the current path is increased by the second heating element.

BRIEF DESCRIPTION OF THE DRAWINGS

The present invention will be explained in greater detail with reference to the enclosed schematic diagrams in the figures, in which.

Elements having the same function and mode of operation are provided in FIGS. 1 to 4 with the same reference characters in each case.

DETAILED DESCRIPTION OF THE EXAMPLE EMBODIMENTS

Figure 1:
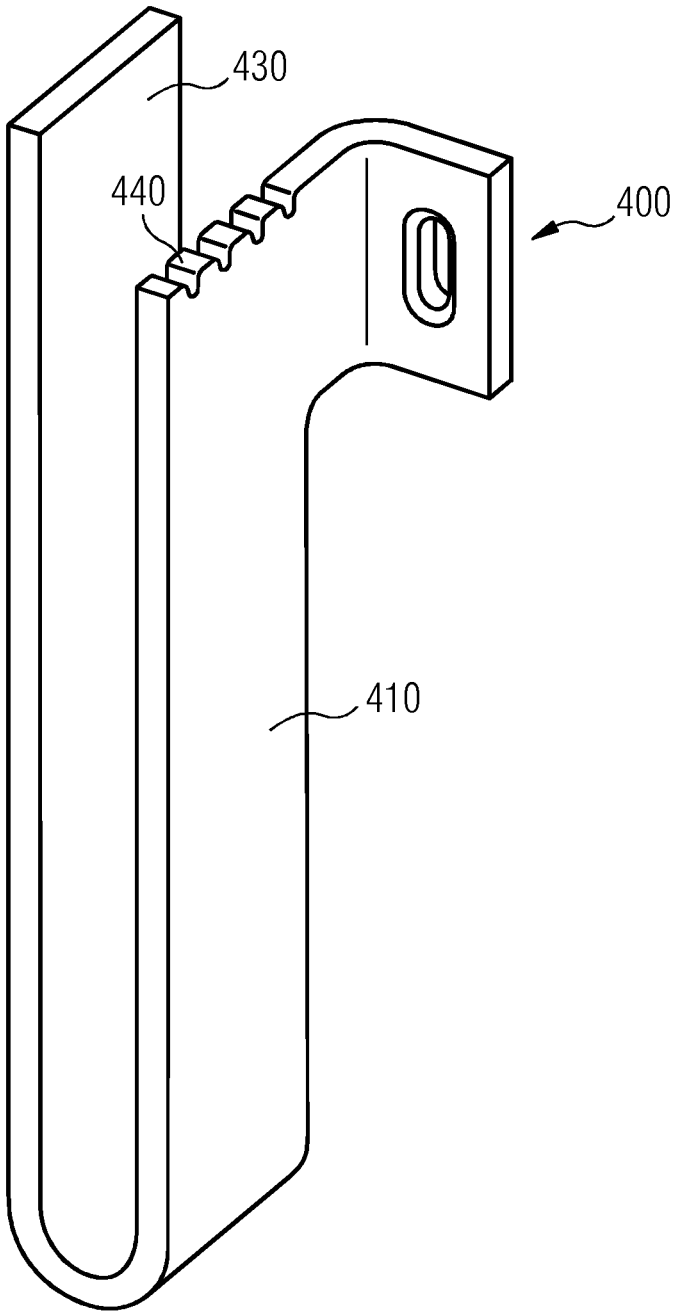
FIG. 1 shows a perspective view of a possible embodiment of the second heating element of an inventive thermomagnetic trip.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

A thermomagnetic trip is disclosed in at least one embodiment for an electrical switching device, especially for a circuit breaker, and includes at least one first and one second terminal, a first heating element, a conductor able to be influenced by temperature, a yoke and a clapper armature, wherein a current path is formed through at least the first terminal, the conductor able to be influenced by temperature, the first heating element and the second terminal and whereby the current path is disposed at least in sections on and/or in the yoke such that a magnetic field acting on the clapper armature is initiated by a current flowing through the current path. In particular there is provision, in a thermomagnetic trip for an electrical switching device, for a second heating element to be disposed in the current path between the first terminal and the conductor able to be influenced by temperature. The resistance of the current path is increased by the second heating element.

Furthermore the first terminal and the conductor able to be influenced by temperature are thermally separated by the second heating element. A flowing away of heat of the conductor able to be influenced by temperature to the first terminal can be avoided in this way. Furthermore the input of heat to the conductor able to be influenced by temperature can additionally be increased by the second heating element. The influencing of the conductor able to be influenced by temperature is increased by this greater temperature input. Through this the tripping behavior of the thermal trip part of the thermomagnetic trip is improved such that tripping occurs even with lower current flows. Use of at least one embodiment of the inventive thermomagnetic trip for small current ranges is thus possible. A suitable choice of material and/or the geometry of the second heating element also enables the tripping point of the thermal trip part to be set precisely.

Furthermore, in at least one embodiment of an inventive thermomagnetic trip, there can be provision for the conductor able to be influenced by temperature to consist at least in sections of a bimetal. A bimetal in such cases is mostly a strip or a band including at least two layers of different metals, especially with different coefficients of thermal expansion. The two metals in such cases are connected non-positively and/or positively to one another. When the temperature of the bimetal changes, especially heats up, the bimetal bends. Such a heat input can occur for example in a thermomagnetic trip by the current flowing through the bimetal. The temperature input is increased further by the first and the second heating element. At a value of the bending of the bimetal defined in advance the thermal trip part trips and the flow of current is interrupted. The use of bimetal for the conductor able to be influenced by temperature thus represents an especially simple embodiment of a conductor able to be influenced by temperature.

In addition there can be provision, in at least one embodiment of an inventive thermomagnetic trip, for at least one of the two heating elements to be embodied at least in sections in a meander shape, a zig-zag shape or a serpentine shape. Other forms of the heating element are of course also conceivable. Heat is generated in the two heating elements by flowing current. The generated heat in such cases is dependent on the resistance of the respective heating element and the length of conductor through which the current flows. The length of the respective heating element through which the current flows and thus the heating effect, i.e. the heat emitted, is increased by the meander shape, zig-zag shape or serpentine shape. At the same time such an embodiment of the respective heating element can lead to a reduction of the cross-section of the heating element, through which the heating effect can likewise be increased. In particular, by adapting the shape of the respective heating element, the heat emitted can be set for a specific current flowing through the heating element and thereby the tripping behavior of the thermal trip part can be influenced. An especially good adjustability to requirements of at least one embodiment of an inventive thermomagnetic trip is thus possible.

At least one embodiment of an inventive thermomagnetic trip can further be characterized in that the conductor able to be influenced by temperature can be disposed at least in sections within the yoke. The yoke can in such cases be embodied in a U shape and the conductor able to be influenced by temperature can especially be disposed on the base of the U-shaped yoke. The arrangement of the conductor able to be influenced by temperature within the yoke makes an especially good induction of a magnetic field in the yoke possible. A magnetic field is generated around the conductor able to be influenced by temperature by the current which flows through the conductor able to be influenced by temperature. By the arrangement of the conductor within the yoke the transfer of the magnetic field of the conductor into the yoke is especially effective. With the same current an especially large magnetic field is generated by this type of arrangement, through which the tripping behavior of the magnetic trip part can be improved. Thus the thermomagnetic trip, especially the magnetic trip part, is activated even more quickly in the event of a short circuit, whereby the protection function of at least one embodiment of the inventive thermomagnetic trip can be designed even more effectively.

In addition there can also be provision in a thermomagnetic trip for the second heating element to be disposed at least in sections within the yoke. Current which flows through the conductor able to be influenced by temperature also flows through the second heating element. The same advantages are thus produced by the arrangement of the second heating element within the yoke as those which have been already described for the arrangement of the conductor able to be influenced by temperature within the yoke.

In an especially preferred development of at least one embodiment of an inventive thermomagnetic trip there can be provision for the currents which flow in the sections of the conductor able to be influenced by temperature and of the second heating element disposed within the yoke respectively to have a same direction of flow. Through this the strength of the current effectively flowing within the yoke, which is produced by the sum of the currents flowing in the conductor able to be influenced by temperature and in the second heating element, is increased. The magnetic field induced by current is dependent on the strength of the current and on the number of windings that the current path has within the yoke. A far greater magnetic field is induced in the yoke by the same current direction in the sections disposed within the yoke than by only one of the sections disposed within the yoke in each case. The tripping behavior of the magnetic part of the thermomagnetic trip can again be greatly enhanced by this.

Furthermore, in at least one embodiment of an inventive thermomagnetic trip, there can be provision for the second heating element to be embodied in a U shape. The U-shaped embodiment in this case represents an especially simple method of providing the second heating element for installation in at least one embodiment of an inventive thermomagnetic trip. A meander-shaped, zig-zag-shaped or serpentine-shaped embodiment of this second heating element is of course still possible.

In a further development of at least one embodiment of an inventive thermomagnetic trip there can be provision for the second heating element embodied in a U shape to be disposed in the thermomagnetic trip such that a first arm is disposed at least in sections within the yoke and a second arm is disposed at least in sections outside the yoke. The second heating element is disposed in the current path, i.e. current flows through it. The U-shaped embodiment and the arrangement such that a first arm is disposed at least in sections within the yoke and a second arm at least in sections outside the yoke, means that the second heating element forms at least approximately a conductor loop around the yoke. A magnetic field formed by current flowing in the second heating element is induced into the yoke especially effectively by this type of arrangement. The magnetic field induced in the yoke is thus increased further. This additionally improves the tripping behavior of the magnetic part of the thermomagnetic trip.

There can further be provision in at least one embodiment of an inventive thermomagnetic trip for the second heating element and the conductor able to be influenced by temperature to be connected by a wire. A wire in this case represents a flexible connection through which current flows between the second heating element and the conductor able to be influenced by temperature. This enables a current connection to be ensured even in the event of a deflection or bending of the conductor able to be influenced by temperature. This can be of advantage if an external mechanism for current disconnection is activated by the conductor able to be influenced by temperature, especially by a movement of the conductor able to be influenced by temperature.

In accordance with a second aspect of at least one embodiment of the invention, an electrical switching device having a thermomagnetic trip is disclosed. The electrical switching device is embodied in this case such that the thermomagnetic trip is embodied in accordance with at least one embodiment of the first aspect of the invention. All advantages that have been described in connection with a thermomagnetic trip in accordance with at least one embodiment of the first aspect of the invention are thus also produced for an electrical switching device of which the thermomagnetic trip is embodied in accordance with at least one embodiment of the first aspect of the invention.

There can further be provision in at least one embodiment of the inventive electrical switching device for this switching device to be a circuit breaker, especially a compact circuit breaker. A circuit breaker in this case is an electromagnetic automatic circuit breaker. It is often also used as a line circuit breaker, i.e. as an overcurrent device in an electro installation. In particular a compact circuit breaker is often used in such cases for low voltages. A use as a motor circuit breaker is also possible. An embodiment of the inventive electrical switching device as a circuit breaker, especially as a compact circuit breaker, thus makes it possible to use the electrical switching device for a plurality of applications.

FIG. 1 shows a possible embodiment of a second heating element 400 of an inventive thermomagnetic trip 1. The embodiment shown is a U-shaped embodiment of the second heating element 400. The second heating element 400 therefore has a first arm 410 and a second arm 430. In particular there can be provision for the first arm 410 to be disposed inside and for the second arm 430 to be disposed outside a yoke 100 (not shown) of the thermomagnetic trip 1. Through this the yoke 100 is at least approximately surrounded by the second heating element 400. This means that the second heating element 400 at least approximately forms a conductor loop around the yoke 100, through which the current flowing through the second heating element 400 induces a magnetic field especially effectively in the yoke 100. The embodiment of the second heating element 400 shown further features an encoding section 440. There can be provision, for the use of an inventive thermomagnetic trip 1 for different current ranges, for different second heating elements 400 to be provided. These different second heating elements 400 which can especially include different materials and/or can be differently shaped, can each be given a separate encoding section 440. This enables the different second heating elements 400 to be distinguished especially easily. The tab disposed in the vicinity of the encoding section 440 has a flat surface and features a solder tag for a fixed connection to the second terminal 700 (not depicted). At the end of the opposing second arm 438 a connection to a wire 500 (not depicted) can be provided.

Figure 2:
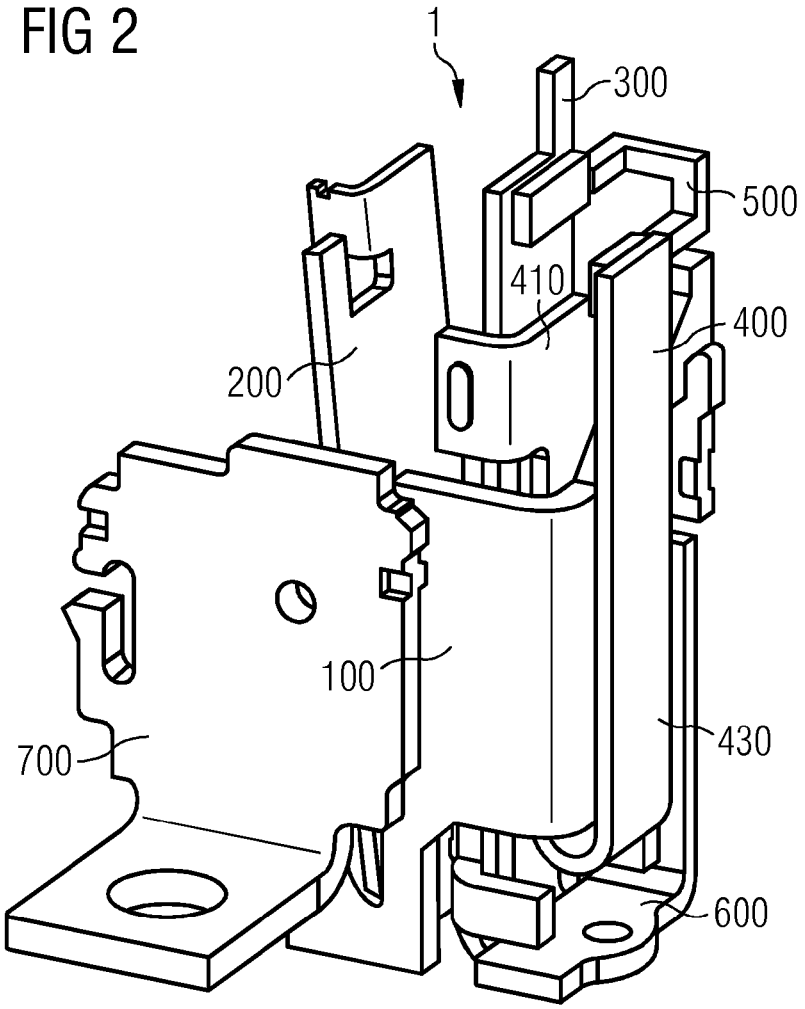
FIG. 2 shows a perspective view of a possible embodiment of an inventive thermomagnetic trip.

FIG. 2 shows a possible embodiment of an inventive thermomagnetic trip 1. The thermomagnetic trip 1 is installed here in a compact design around a yoke 100. A clapper armature 200 is disposed here opposite the yoke 100. The clapper armature 200 can for example be pre-tensioned with a spring force in such cases and in the event of a short circuit, is pulled by the magnetic field then induced in the yoke 100 onto the yoke 100, whereby the circuit is interrupted directly or by a downstream mechanism. The conductor 300 able to be influenced by temperature is disposed within the yoke 100 which, in the embodiment shown, is formed by a bimetal strip. The conductor 300 is connected via a wire 500 to the second arm 430 of the second heating element 400. The second heating element 400 is embodied in a U shape. In this case the second arm 430 of the U-shaped heating element 400 is located outside the yoke and the first arm 410 of the second heating element inside the yoke 100.

It can thus clearly be seen that the yoke 100 lies at least approximately in a double conductor loop which is formed by the conductor 300 able to be influenced by temperature and by the U-shaped second heating element 400. The second heating element 400 has a bent-over tab at the end of the first arm 410 for connection with the second terminal 700. The second terminal 700 is shown still separately from the second heating element 400 in the embodiment, in order not to hide significant features of the structure of the thermomagnetic trip 1. The end of the conductor 300 facing away from the wire 500 is permanently connected to the first heating element 600. The first heating element 600 additionally has a first terminal (not depicted). The current path through the thermomagnetic trip 1 is thus formed by the first terminal, the first heating element 600, the conductor 300, the wire 500, the second arm 430 of the second heating element 400, the first arm 410 of the second heating element 400 and the second terminal 700.

As already described above, in the event of a short circuit, a strong magnetic field is induced in the yoke 100 by the current which is flowing in this current path, through which the clapper armature 200 is moved towards the yoke. In particular the circuit is then interrupted by a mechanism disposed after the clapper armature 200. This represents the magnetic trip part of the thermomagnetic trip 1. Furthermore the first heating element 600, the conductor 300 able to be influenced by temperature and the second heating element 400 heat up during operation. If a current is flowing through the thermomagnetic trip 1, the conductor 300 able to be influenced by temperature is influenced. In particular the conductor 300 able to be influenced by temperature bends. If the current lies permanently above a certain threshold, an overload current is present. In the event of such an overload the circuit will likewise be interrupted by a mechanism likewise connected downstream (not depicted). This represents the thermal trip section of the thermomagnetic trip 1. A thermomagnetic trip 1 thus represents a protection mechanism in an electrical circuit, which can react both to a short circuit and also to an overload situation by disconnecting the circuit.

Figure 3:
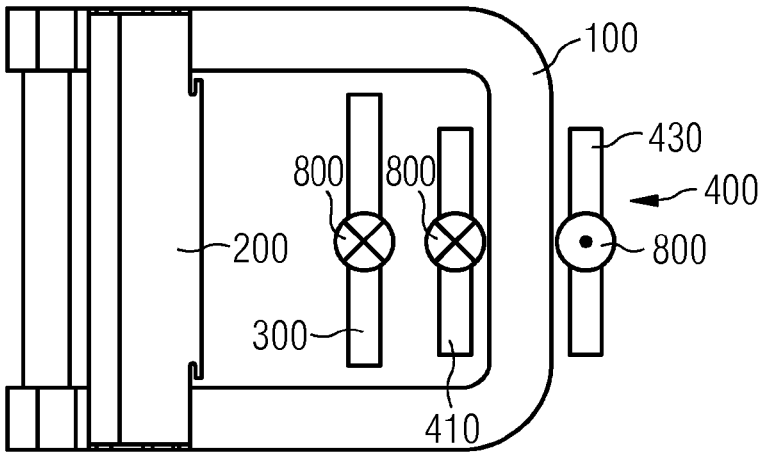
FIG. 3 shows a first cross-sectional view of the thermomagnetic trip shown in FIG. 2

FIG. 3 shows a part cross section of the thermomagnetic trip 1 shown in FIG. 2. Shown in particular are the yoke 100, the clapper armature 200, the conductor 300 able to be influenced by temperature and the second heating element 400. It is particularly evident from this view that the second arm 430 of the second heating element 400 is disposed outside the yoke 100 and the first arm 410 of the second heating element 400 is disposed inside the yoke 100. Also disposed inside the yoke is the conductor 300 able to be influenced by temperature.

Also indicated for the conductor 300 and the two arms 410, 430 of the second heating element 400 is the prevailing current direction 800 within them. In this figure a circle with a cross indicates a current direction 800 into the plane of the drawing and a circle with a dot indicates a current direction 800 out of the plane of the drawing. Naturally a reversal of the current directions and especially of the use of the thermomagnetic trip 1 in an AC circuit is conceivable. It is especially clear here that the two current-conducting sections disposed within the yoke 100, the conductor 300 and the first arm 410 of the second heating element 400, have the same current direction 800. The second arm 430 of the second heating element 400 also has a current running in the opposite direction. The magnetic field generated by the three sections through which current flows is especially large by virtue of this arrangement of the current directions 800. The force which acts via the magnetic field induced in the yoke 100 on the clapper armature 200 is especially large as a result. Thus the embodiment shown provides an especially good tripping characteristic for the magnetic trip part of the thermomagnetic trip 1.

Figure 4:
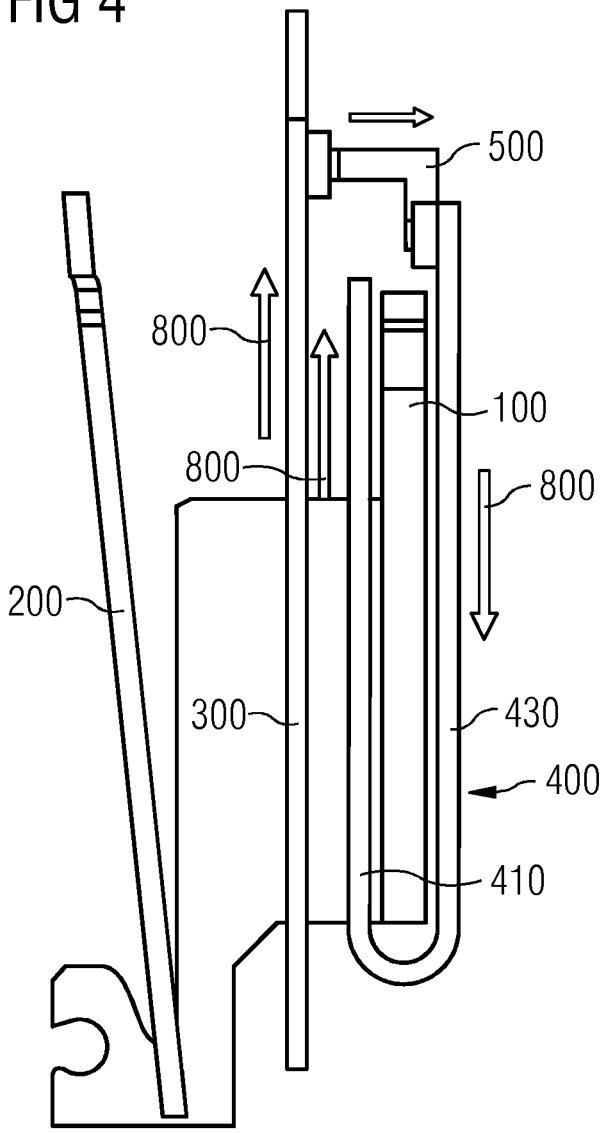
FIG. 4 shows a second cross-sectional view of the thermomagnetic trip shown in FIG. 2.

FIG. 4 shows a further sectional view of the thermomagnetic trip 1 shown in FIG. 2. The sectional plane of the sectional view in this case is at right angles to the sectional view as depicted in FIG. 3. In addition to the elements already described in FIG. 3, the wire 500 is also shown in FIG. 4. The support of the clapper armature 200 is also shown, which is formed by an extension of the yoke 100. The current path is also shown in this sectional view, wherein the current direction 800 in the individual sections is once again represented by arrows. The current flows through the conductor 300 able to be influenced by temperature via the wire 500 into the second heating element 400. In particular the current flows from the wire 500 outside the yoke 100 into the second arm 430 of the second heating element 400 and subsequently back inside the yoke through the first arm 410 of the second heating element 400. Naturally a reversal of the current directions and especially the use of the thermomagnetic trip 1 in an alternating current circuit is conceivable. In this way, especially by the U-shaped embodiment of the second heating element 400, a current direction 800 running in the same direction within the yoke in conductor 300 and in first arm 410 of the second heating element 400 can be achieved. This in its turn produces an especially large induced magnetic field in yoke 100.

The result achieved by connecting the second heating element between the conductor 300 able to be influenced by temperature and the second terminal 700 (not depicted) is that no heat can flow away directly from the conductor 300 able to be influenced by temperature to the second terminal 700. This arrangement and the fact that the conductor 300, at its end facing away from the wire 500, is connected to the first heating element 600 (not shown in the figure), means that an especially good thermal tripping behavior of the thermomagnetic trip 1 is produced, since the heat introduced into the conductor 300 able to be influenced by temperature is especially almost completely used for the influencing of the conductor 300, especially for the bending of a conductor 300 embodied as a bimetal. This produces an especially good tripping characteristic of the thermal part of the thermomagnetic trip 1.

The present explanation of the embodiments only describes the present invention within the framework of examples. Naturally individual features of the embodiments can be freely combined with one another, where this makes sense technically, without departing from the framework of the present invention.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the drawings, and, by way of combinable features, lead to a new subject matter or to new method steps or sequences of method steps, including insofar as they concern production, testing and operating methods.

References throughout the specification and drawings that indicate further embodiments of the subject matter of inventive concepts should not be understood to limit other embodiments.

Furthermore, in inventive concepts where a feature is concretized in more specific detail, it should be assumed that such a restriction is not limiting.

Since the subject matter of inventive concepts may form separate and independent inventions, the applicant reserves the right to make them the subject matter of divisional declarations. They may furthermore also contain independent inventions which have a configuration that is independent of the subject matters of some inventive concepts.

Further, elements and/or features of different example embodiments may be combined with each other and/or substituted for each other within the scope of this disclosure.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of inventive concepts.

LIST OF REFERENCE CHARACTERS

1 Thermomagnetic trip
100 Yoke
200 Clapper armature
300 Conductor
400 Second heating element
410 First arm
430 Second arm
440 Encoding section
500 Wire
600 First heating element
700 Second terminal
800 Current direction

What is claimed is:

1. A thermomagnetic trip for an electrical switching device, comprising:

at least one first terminal and at least one second terminal;

a first heating element;

a conductor, a conductivity of the conductor being influenced by temperature;

a yoke and a clapper armature, wherein the first terminal, the conductor, the first heating element, and the second terminal are electrically connected such that a current path is formable through at least the first terminal, the conductor, the first heating element and the second terminal, and wherein the current path is disposed at least in sections at least one of on and in the yoke such that a magnetic field acting on the clapper armature is induceable in the yoke by the current flowing through the current path; and a second heating element, electrically connected between the first terminal and the conductor so as to be disposed in the current path, the second heating element being influenced by temperature, wherein, the conductor and a first section of the second heating element extend along a first face of the yoke and conduct current in a first direction, a second section of the second heating element extends along a second face of the yoke and conducts current in a second direction, substantially opposite to the first direction, and the yoke is between the first section and the second section such that the first face faces toward the first section, the clapper armature, and the conductor, and the second face faces the second section.

2. The thermomagnetic trip of claim 1, wherein the conductor includes, at least in sections, a bimetal.

3. The thermomagnetic trip of claim 1, wherein at least one of the is embodied, at least in sections, in a meander shape, a zig-zag shape or a serpentine shape.

4. The thermomagnetic trip of claim 1, wherein the conductor is disposed at least in sections within the yoke.

5. The thermomagnetic trip of claim 1, wherein first section of the second heating element is disposed within the yoke.

6. The thermomagnetic trip of claim 1, wherein the second heating element is embodied in a U shape.

7. The thermomagnetic trip of claim 1, wherein the second heating element and the conductor are connected by a wire.

8. An electrical switching device comprising the thermomagnetic trip of claim 1.

9. The electrical switching device of claim 8, wherein the electrical switching device is a circuit breaker.

10. The electrical switching device of claim 9, wherein the circuit breaker is a compact circuit breaker.

11. The thermomagnetic trip of claim 1, wherein the electrical switching device is for a circuit breaker.

12. The thermomagnetic trip of claim 1, wherein a third section of the second heating element wraps around an end of the yoke to electrically connect the first section and the second section.

* * * * *